US009335736B2

(12) United States Patent
Umemoto et al.

(10) Patent No.: US 9,335,736 B2
(45) Date of Patent: May 10, 2016

(54) IMAGE FORMING APPARATUS

(71) Applicant: Konica Minolta, Inc., Chiyoda-ku, Tokyo (JP)

(72) Inventors: Hiroaki Umemoto, Neyagawa (JP); Shigeru Tashiro, Toyokawa (JP); Masayuki Satou, Toyohashi (JP); Masahiro Yamaguchi, Toyokawa (JP); Shoichi Yoshikawa, Okazaki (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/789,172

(22) Filed: Jul. 1, 2015

(65) Prior Publication Data

US 2016/0004218 A1 Jan. 7, 2016

(30) Foreign Application Priority Data

Jul. 1, 2014 (JP) ..... 2014-135806

(51) Int. Cl.
*G03G 21/20* (2006.01)

(52) U.S. Cl.
CPC ..... *G03G 21/206* (2013.01); *G03G 2221/1645* (2013.01)

(58) Field of Classification Search
CPC ..... G03G 21/20; G03G 21/206; G03G 2221/1645
See application file for complete search history.

(56) References Cited

U.S. PATENT DOCUMENTS

2012/0240534 A1 9/2012 Ryuzaki

FOREIGN PATENT DOCUMENTS

| | | | |
|---|---|---|---|
| JP | 11153894 | A | 6/1999 |
| JP | 2011075997 | A | 4/2011 |
| JP | 2012068489 | A | 4/2012 |
| JP | 2012203251 | A | 10/2012 |

*Primary Examiner* — Erika J Villaluna
(74) *Attorney, Agent, or Firm* — Cantor Colburn LLP

(57) ABSTRACT

An image forming apparatus having: an inside-air duct having a first inlet to an inside of the image forming apparatus; a first ventilator provided in the inside-air duct; an outside-air duct having a second inlet to an outside of the image forming apparatus; a common duct into which the inside-air duct and the outside-air duct are merged; a second ventilator provided in at least one of the outside-air duct and the common duct; a filter provided in the common duct; and a control section that retrieves information indicative of an flow rate in the inside-air duct and increases a pressure produced by the second ventilator based on the retrieved information such that an flow rate in the outside-air duct is substantially constant with respect to an increase of the flow rate in the inside-air duct.

6 Claims, 16 Drawing Sheets

IMAGE FORMING APPARATUS

This application is based on Japanese Patent Application No. 2014-135806 filed on Jul. 1, 2014, the content of which is incorporated herein by reference.

BACKGROUND OF THE INVENTION

1. Field of the Invention

The present invention relates to an image forming apparatus including an air cleaner.

2. Description of Related Art

Common image forming apparatuses include an air cleaner for expelling air inside the apparatus to the outside. More specifically, in a fixing unit of the image forming apparatus, emissions such as an odor, volatile organic compounds (VOC), low molecular siloxane, dust (toners or paper dust), etc., are produced. The air cleaner includes a ventilator (typically, a fan) and a filter in an air passage. The ventilator is driven to collect air around the fixing unit. Emissions contained in the collected air are captured by the filter, and the cleaned air is expelled to the outside of the apparatus. Also, the image forming apparatus includes another ventilator for cooling a developing unit or paper sheets. An air flow produced by this ventilator is also expelled to the outside of the apparatus via the air cleaner.

In recent years, concern about the air quality has been increasing, and hence, there has been a demand for an image forming apparatus which is capable of cleaning air of an installation space.

In view of the above background, image forming apparatuses which are capable of cleaning air inside and outside the apparatuses have been recently proposed. For example, Japanese Patent Laid-Open Publication No. 2012-203251 discloses the following image forming apparatus. Specifically, an inside-air duct takes in the air inside the apparatus, and an outside-air duct takes in the air of the installation space of the apparatus (i.e., the air outside the apparatus). These air flows are merged and guided through a common duct and passed through an exhaust gas filter placed in the common duct. Thereafter, the air which has been passed through the exhaust gas filter is expelled to the outside of the apparatus from a common outlet placed at the most downstream position of the common duct.

However, in the case where the air from the inside and outside of the apparatus are expelled from the common outlet as in Japanese Patent Laid-Open Publication No. 2012-203251, a backflow is likely to occur due to interaction between the inside-air duct and the outside-air duct. This is because, when the flow rate in the inside-air duct varies, the pressure at the junction of the inside-air duct and the outside-air duct varies, and the pressure variation affects the flow rate in the outside-air duct. Particularly, there is a probability that emissions are remaining in the air inside the apparatus, and therefore, it is necessary to avoid a backflow to the outside-air duct when the flow rate in the inside-air duct varies.

Thus, an object of the present invention is to provide an image forming apparatus which is capable of preventing a backflow of air from the inside-air duct to the outside-air duct.

SUMMARY OF THE INVENTION

The first aspect of the present invention is an image forming apparatus having; an inside-air duct having a first inlet to an inside of the image forming apparatus; a first ventilator provided in the inside-air duct; an outside-air duct having a second inlet to an outside of the image forming apparatus; a common duct into which the inside-air duct and the outside-air duct are merged; a second ventilator provided in at least one of the outside-air duct and the common duct; a filter provided in the common duct; and a control section configured to retrieve information indicative of an flow rate in the inside-air duct and to increase a pressure produced by the second ventilator based on the retrieved information such that an flow rate in the outside-air duct is substantially constant with respect to an increase of the flow rate in the inside-air duct.

DETAILED DESCRIPTION OF THE PREFERRED EMBODIMENTS

Figure 1:
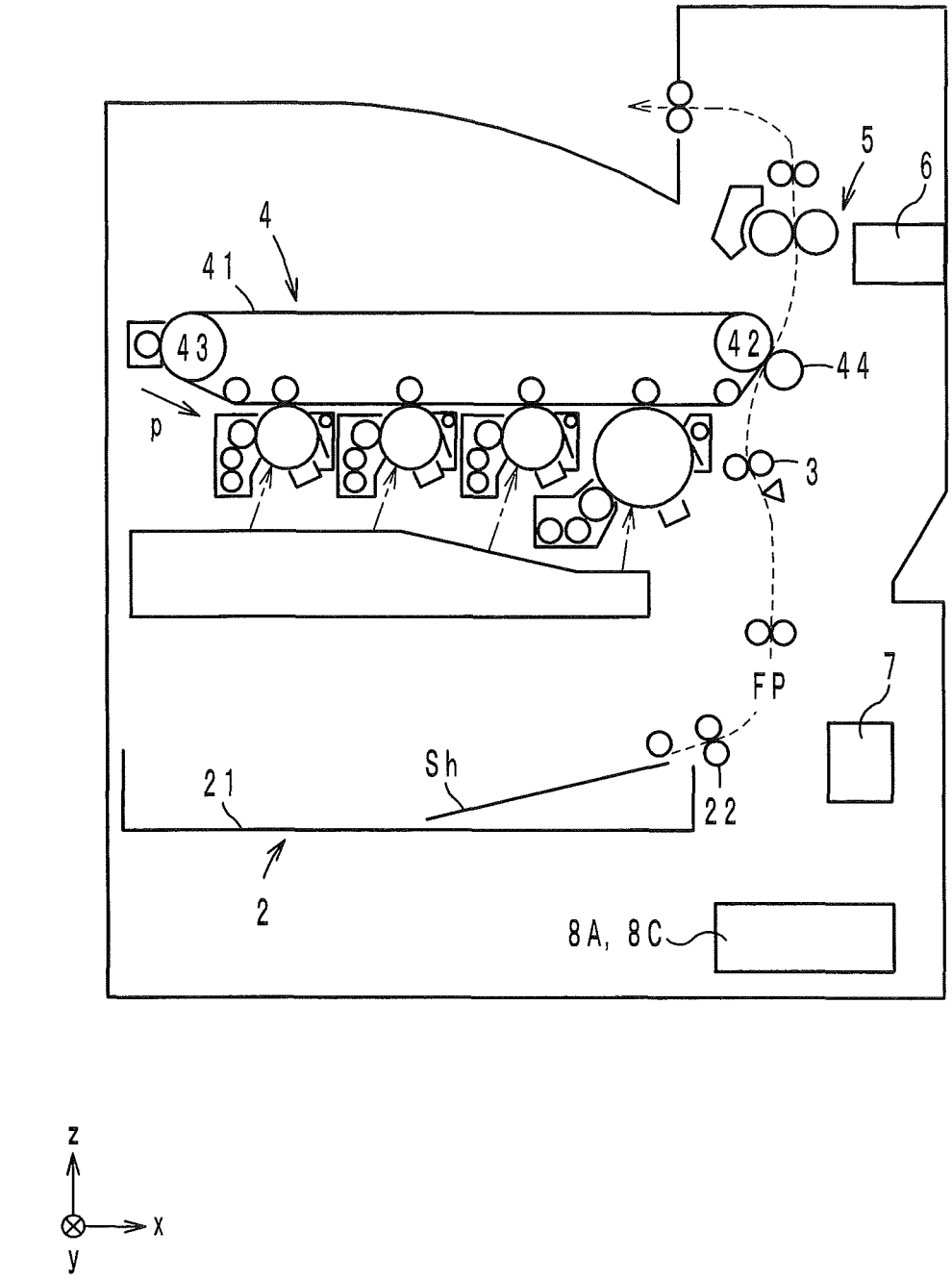
FIG. 1 is a vertical cross-sectional view parallel to the zx plane of each image forming apparatus.

Hereinafter, image forming apparatuses of respective embodiments are described with reference to the drawings.

Definition

Firstly, the x-direction, the y-direction and the z-direction in the drawings are defined. The x-direction, the y-direction and the z-direction are generally perpendicular to one another. The x-direction represents a direction from the left to the right of the image forming apparatuses 1A to 1C. The y-direction represents a direction from the front to the rear of the apparatuses 1A to 1C. The z-direction represents a direction from the bottom to the top of the apparatuses 1A to 1C. The −x direction, the −y direction and the −z direction are opposite to the x-direction, the y-direction and the z-direction, respectively.

Configuration of Image Forming Apparatus

In FIG. 1, an image forming apparatus 1A is, for example, a copying machine, printer or facsimile machine, or a multifunction printer having the functions of these machines, and is configured to print a full-color image on a sheet Sh (e.g., paper or OHP film), for example. This image forming apparatus 1A generally includes at least one sheet feeding unit 2, a resist roller pair 3, an image forming section 4, a fixing unit 5, a console panel 6, a control section 7, and an air cleaner 8A.

The sheet feeding unit 2 includes a sheet tray 21 and a sheet feeding roller pair 22. The sheet tray 21 is loaded with sheets Sh which are not yet printed. The sheet feeding roller pair 22 is rotated by a driving force from an unshown motor and feed the sheets Sh in a one-by-one manner from the sheet tray 21 to a sheet path FP represented by a broken line in the drawing.

The resist roller pair 3 is provided on the sheet path FP, downstream of the sheet feeding roller pair 22, so as to form a nip. While the resist roller pair 3 is not in operation, the sheet Sh from the sheet feeding unit 2 strikes against the nip and temporarily stops. Thereafter, the resist roller pair 3 starts to rotate by a driving force from an unshown motor, thereby forwarding the sheet Sh to the secondary transfer area which will be described later.

The image forming section 4 is configured to form a full-color toner image based on well-known electrophotographic and tandem systems, for example. The image forming section 4 includes an intermediate transfer belt 41, a driver roller 42, a follower roller 43, and a secondary transfer roller 44.

The intermediate transfer belt 41 is an endless belt wrapped around the driver roller 42 that is rotatable by a driving force generated by an unshown motor and the follower roller 43 that follows the rotation of the driver roller 42. The intermediate transfer belt 41 is rotatable in the direction represented by arrow p. Toner images of the YMCK colors formed in the image forming section 4 are transferred to the same area on this intermediate transfer belt 41, whereby a full-color composite toner image is formed. The transferred composite toner image supported on the intermediate transfer belt 41 is carried by the intermediate transfer belt 41 to the secondary transfer area which will be described later.

The secondary transfer roller 44, which is located on the right side of the driver roller 42, opposes the driver roller 42 with the intermediate transfer belt 41 interposed therebetween. On the sheet path FP, the secondary transfer roller 44 is in contact with the intermediate transfer belt 41 so as to form the secondary transfer area. The sheet Sh is forwarded to this secondary transfer area as described above. While the sheet Sh passes through the secondary transfer area, the toner image is transferred from the intermediate transfer belt 41 to the sheet Sh. Thereafter, the sheet Sh is forwarded to the fixing unit 5 located on the downstream side in the sheet path FP.

The fixing unit 5 fixes the toner image on the sheet Sh. The sheet Sh forwarded from the fixing unit 5 is ejected via an ejection roller pair to an ejection tray located on the downstream side in the sheet path FP.

The console panel 6 includes a numeric keypad, a touch panel, etc. A user operates the console panel 6 to enter various information.

Figure 3:
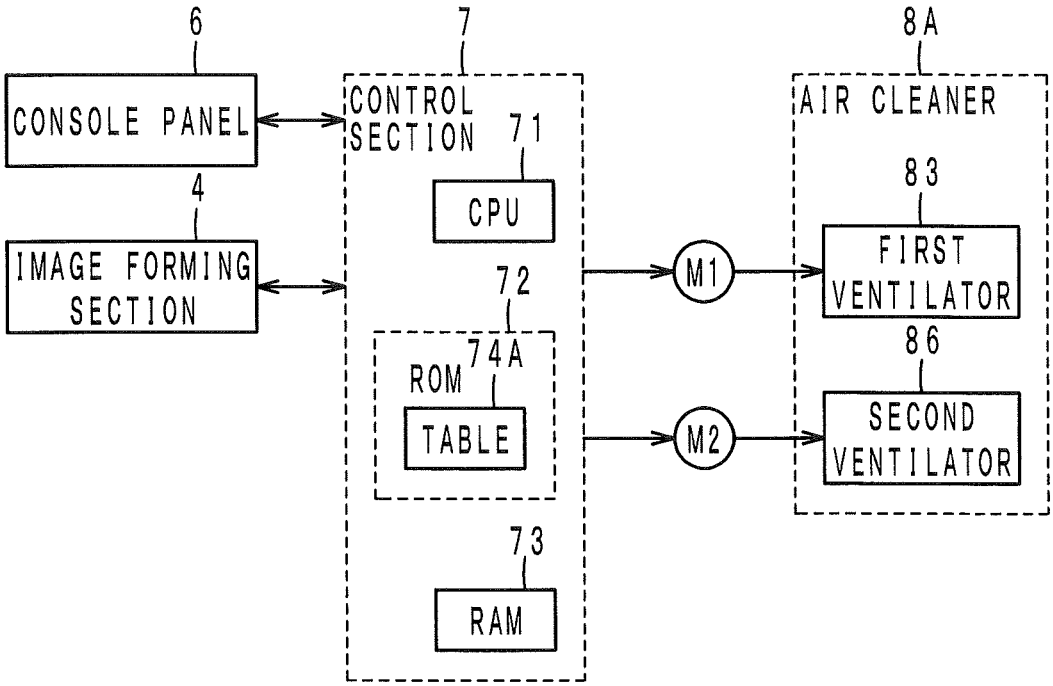
FIG. 3 is a control block diagram of the air cleaner of FIG. 1.

The control section 7 includes a CPU 71, a ROM 72, and a RAM 73 as shown in FIG. 3. The CPU 71 executes a program retrieved from the ROM 72 using the RAM 73 as a work area, thereby controlling respective components of the image forming apparatus 1A.

The air cleaner 8A cleans the air inside the image forming apparatus 1A and expels the cleaned air and, meanwhile, cleans the air outside the image forming apparatus 1A and expels the cleaned air.

Configuration of Air Cleaner

Figure 2:
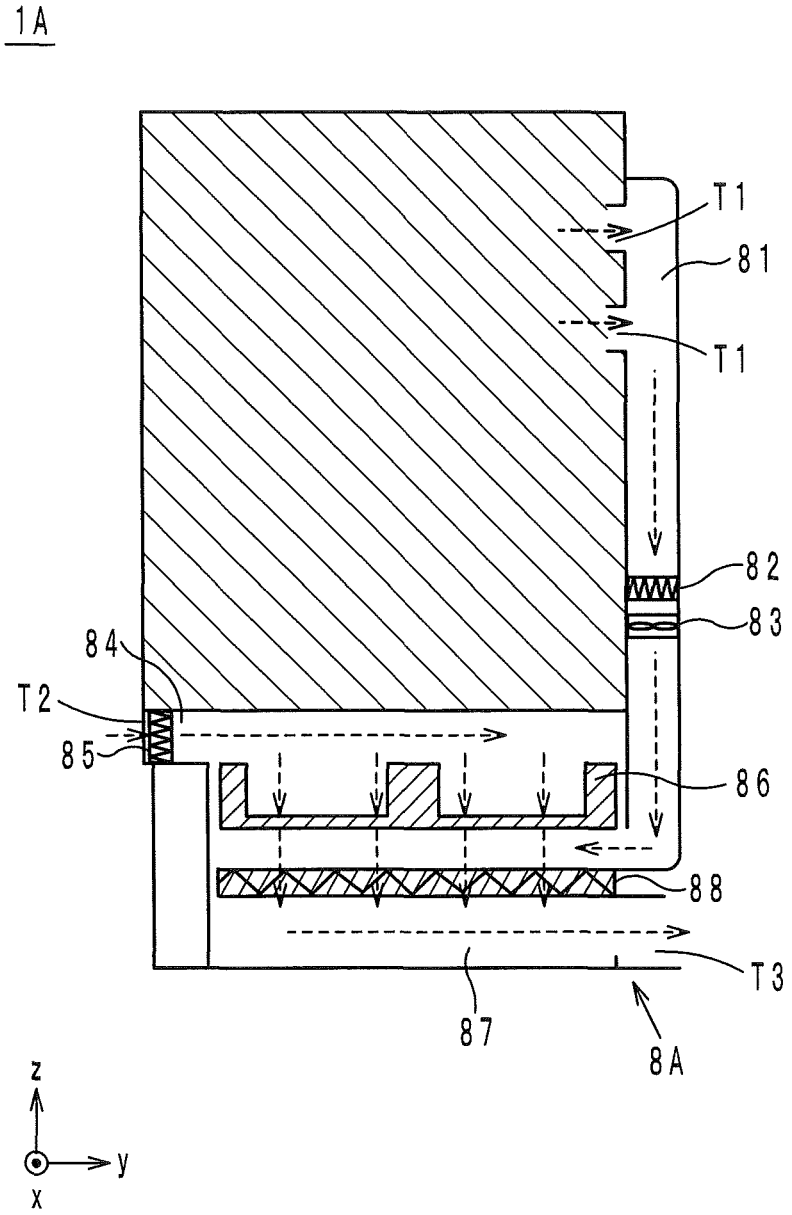
FIG. 2 is a vertical cross-sectional view parallel to the yz plane of an air cleaner of FIG. 1.

Hereinafter, the configuration of the air cleaner 8A is described in detail with reference to FIG. 2 and FIG. 3. The air cleaner 8A is provided on the rear surface and in the lower portion of the image forming apparatus 1A. The air cleaner 8A generally includes an inside-air duct 81, an inside-air filter 82, a first ventilator 83, an outside-air duct 84, an outside-air filter 85, a second ventilator 86, a common duct 87, a common filter 88, a motor M1, and a motor M2.

The inside-air duct 81 is provided on the rear surface of the image forming apparatus 1A so as to extend in the −z direction and has a generally constant cross-sectional area. The upper end portion of the inside-air duct 81 has at least one first inlet T1 which is open to the inside of the image forming apparatus 1A. The first inlet T1 is in communication with various ducts (not shown) provided inside the image forming apparatus 1A. One of these ducts takes in the air around the fixing unit 5 and guides it to the first inlet T1. Another duct is, for example, provided together with a ventilator for air-cooling of surroundings of a developing unit of the image forming section 4. Any other duct may be provided inside the image forming apparatus 1A. The lower end portion of the inside-air duct 81 is in communication with the common duct 87 that will be described later.

The inside-air filter 82 is provided in the air passage inside the inside-air duct 81. The area of the inside-air filter 82 is generally equal to the cross-sectional area of the inside-air duct 81.

The first ventilator 83 is, for example, a blast fan and is provided immediately downstream of the inside-air filter 82 in the air passage inside the inside-air duct 81. The motor M1 is coupled with this first ventilator 83. The control section 7 controls the number of revolutions of the motor M1 by PWM control or variable-speed control, and the first ventilator 83 is rotated by a driving force from the motor M1, whereby a pressure is produced at the downstream side in the air passage. Accordingly, the air inside the image forming apparatus 1A is taken in the first inlet T1 of the inside-air duct 81 and then guided through the air passage inside the inside-air duct 81 toward the common duct 87. From the air guided through the air passage, emissions and the like are removed by the inside-air filter 82 provided in the middle of the air passage. Hereinafter, this operation is referred to as "inside-air cleaning".

The outside-air duct 84 is provided in, for example, the lower portion of the image forming apparatus 1A. The outside-air duct 84 extends in the y-direction from the front surface of the image forming apparatus 1A and bends in the middle to extend in the −z direction. The front end of the outside-air duct 84 has a second inlet T2 which is open to the outside (more specifically, frontward) of the image forming apparatus 1A. The rear end portion of the outside-air duct 84 is in communication with the common duct 87 that will be described later.

The outside-air filter 85 is provided immediately downstream of the second inlet T2 in the air passage inside the outside-air duct 84 (in other words, near the upstream end of the outside-air duct 84). The area of the outside-air filter 85 is generally equal to the cross-sectional area of the second inlet T2.

The second ventilator 86 is a blast fan, for example, and is provided near the downstream end in the air passage inside the outside-air duct 84. The motor M2 is coupled with the second ventilator 86. The control section 7 controls the number of revolutions of the motor M2 by PWM control, and the second ventilator 86 is rotated by a driving force from the motor M2, whereby a pressure is produced at the downstream side in the air passage. Accordingly, the air of the installation space of the image forming apparatus 1A (i.e., outside air) is taken in the second inlet T2 and then guided through the outside-air duct 84 toward the common duct 87. Dust and dirt contained in this air are removed by the outside-air filter 85. Hereinafter, this operation is referred to as "outside-air cleaning".

The common duct 87 is provided in, for example, the lowermost portion of the image forming apparatus 1A. The common duct 87 extends in the −z direction on the upstream side and bends in the middle to extend in the y-direction before terminating at the rear surface of the image forming apparatus 1A. At the upstream end of the common duct 87, the downstream ends of the inside-air duct 81 and the outside-air duct 84 merge together so as to be in communication with the common duct 87. Meanwhile, the downstream end of the common duct 87 has an outlet T3 which is open to the outside of the image forming apparatus 1A (more specifically, in the y-direction).

The common filter 88 is provided in the air passage inside the common duct 87, between the communicating portion of the inside-air duct 81 and the outside-air duct 84 and the outlet T3. This common filter 88 removes emissions, dust, etc., from the air guided through the air passage of the common duct 87.

Basic Principle of Control of Air Cleaner

As previously described in paragraph [0006], in the case where air inside and outside the image forming apparatus 1A are expelled from the common outlet T3, a backflow is likely to occur due to interaction between the inside-air duct 81 and the outside-air duct 84. Specifically, in some cases, the air from the inside-air duct 81 does not flow to the outlet T3 but flows to the outside-air duct 84. In view of such, in the present embodiment, the flow rate control is carried out such that the flow rate inside the outside-air duct 84 is kept generally constant irrespective of the variation of the flow rate in the inside-air duct 81, whereby a backflow to the outside-air duct 84 is prevented.

Figure 4:
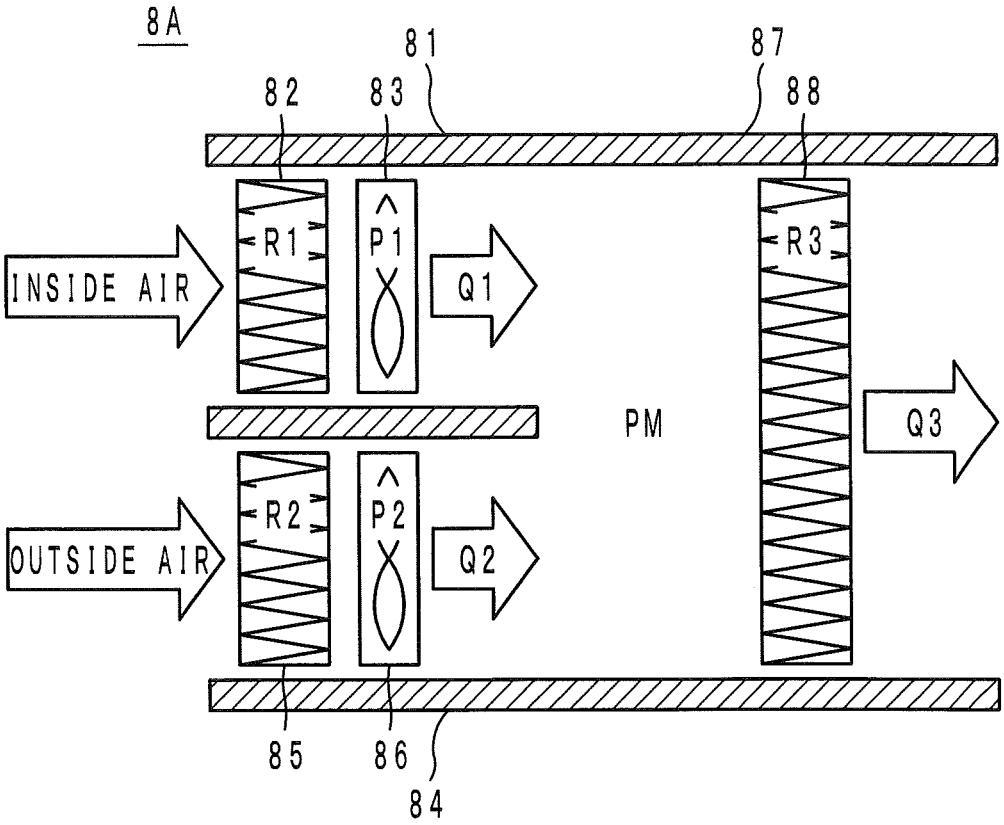
FIG. 4 is a schematic diagram showing the pressure, flow rate and ventilation resistance in a major part of FIG. 1.

Next, the basic concept of the flow rate control of the present embodiment is described with reference to FIG. 4. FIG. 4 shows some variables and constants (known values). These are defined as shown in TABLE 1.

TABLE 1

Definition of Variables/Constants

| Symbol | Variable/ Constant | Definition |
|---|---|---|
| P1 | Variable | Pressure of First Ventilator 83 |
| R1 | Constant | Ventilation resistance of Inside-Air Duct 81 |
| Q1 | Variable | Flow rate in Inside-Air Duct 81 |
| P2 | Variable | Pressure of Second Ventilator 86 |
| R2 | Constant | Ventilation resistance of Outside-Air Duct 84 |
| Q2 | Variable | Flow rate in Outside-Air Duct 84 |
| R3 | Constant | Ventilation resistance of Common Duct 87 |
| Q3(=Q1 + Q2) | Variable | Flow rate in Common Duct 87 |
| PM | Variable | Internal Pressure Between Ventilators 83, 86 and Filter 88 |

In the present embodiment, the filters 82, 85, 88 have large ventilation resistances. Therefore, the ventilation resistances that depend on the shape of the air passages of the ducts 81, 84, 87 are much smaller than the ventilation resistances R1, R2, R3 that depend on the filters 82, 85, 88. In this case, the pressure loss which is attributed to the ventilation resistance of the duct including the filter is the product of the ventilation resistance of the filter and the flow rate. Thus, formulae (1) to (3) shown below hold true. Note that, in FIG. 4, the air is assumed to flow in a rightward direction.

$$P1-PM=R1Q1 \quad (1)$$

$$P2-PM=R2Q2 \quad (2)$$

$$PM=R3(Q1+Q2) \quad (3)$$

From formulae (1) to (3), formula (4) which represents the relationship between P1 and Q1, Q2 and formula (5) which represents the relationship between P2 and Q1, Q2 are obtained as follows.

$$P1=(R1+R3)Q1+R3Q2 \quad (4)$$

$$P2=(R2+R3)Q2+R3Q1 \quad (5)$$

Formulae (4) and (5) are for determining the set values of the pressures P1, P2 for the purpose of achieving the target value of the flow rate Q1 and the target value of the flow rate Q2. Here, to prevent the air from the inside-air duct 81 from forming a backflow to the outside-air duct 84 even though Q1 varies, it is required that Q2 is constant and would not vary irrespective of Q1. A table 74A is created for controlling the first ventilator 83 and the second ventilator 86 so as to satisfy formulae (4) and (5) such that Q2 is constant and would not vary irrespective of Q1. The table 74A is stored in the ROM 72 shown in FIG. 3 in manufacture of the image forming apparatus 1A.

TABLE 2 shows an example of the contents of the table 74A.

TABLE 2

Contents of Table 74A

| | | | | | |
|---|---|---|---|---|---|
| Q1 [$m^3$/min] | 0 | 0.1 | 0.2 | 0.3 | 0.4 |
| Q2 [$m^3$/min] | 0 | 0 | 0 | 0 | 0 |
| P1 Set Value [%] | 0 | 4.3 | 8.6 | 12.9 | 17.1 |
| P2 Set Value [%] | 0 | 2.9 | 5.7 | 8.6 | 11.4 |

Figure 5:
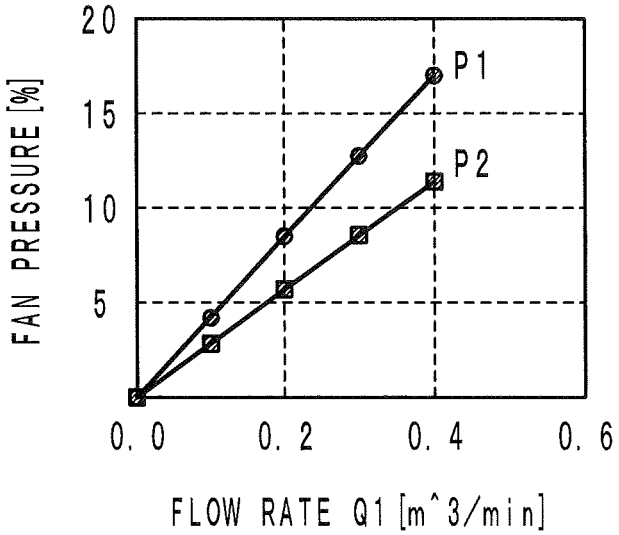
FIG. 5 is a graph of the pressures P1, P2 with respect to the flow rate Q1.

TABLE 2 shows the relationship of P1 to Q1 and the relationship of P2 to Q1, Q2. Note that the unit of P1, P2 is %. This represents the duty ratio in the PWM control of the motors M1, M2. According to TABLE 2, when the first ventilator 83 is off (i.e., when the pressure P1 is 0), the pressure P2 of the second ventilator 86 is set to 0. Relative to this value, the pressure P2 is set generally proportional along with the increase of the pressure P1 as shown in FIG. 5. Also, as previously described, the flow rate Q2 has a generally constant value irrespective of the flow rate Q1. In the example of TABLE 2, the flow rate Q2 is constant at 0, although the present invention is not limited to this example. The flow rate Q2 may be constant at any other value.

The contents described in TABLE 2 are explained more specifically. TABLE 2 describes that Q1 can be adjusted to 0 by setting P1 to 0. Likewise, TABLE 2 describes that Q1 can be adjusted to 0.1, 0.2, 0.3, 0.4 by setting P1 to 4.3, 8.6, 12.9, 17.1. TABLE 2 also describes that, when Q1 is 0, 0.1, 0.2, 0.3, 0.4, Q2 can be kept constant at 0 by setting P2 to 0, 2.9, 5.7, 8.6, 11.4.

Details of Control of Air Cleaner

Next, the control of the air cleaner 8A of the present embodiment is described in detail with reference to FIG. 1 to FIG. 7. Firstly, in FIG. 6, immediately after the main power supply is turned on, the CPU 71 sets an outside-air cleaning flag F, a routine timer, etc., to initial values (S001).

The outside-air cleaning flag F indicates whether or not the image forming apparatus 1A of the present embodiment carries out the outside-air cleaning. In the present embodiment, the outside-air cleaning flag F is either 0 or 1. 0 indicates that the outside-air cleaning is not carried out. 1 indicates that the outside-air cleaning is carried out. It is assumed that, at S001, the outside-air cleaning flag F is set to 0, for example.

Figure 6:
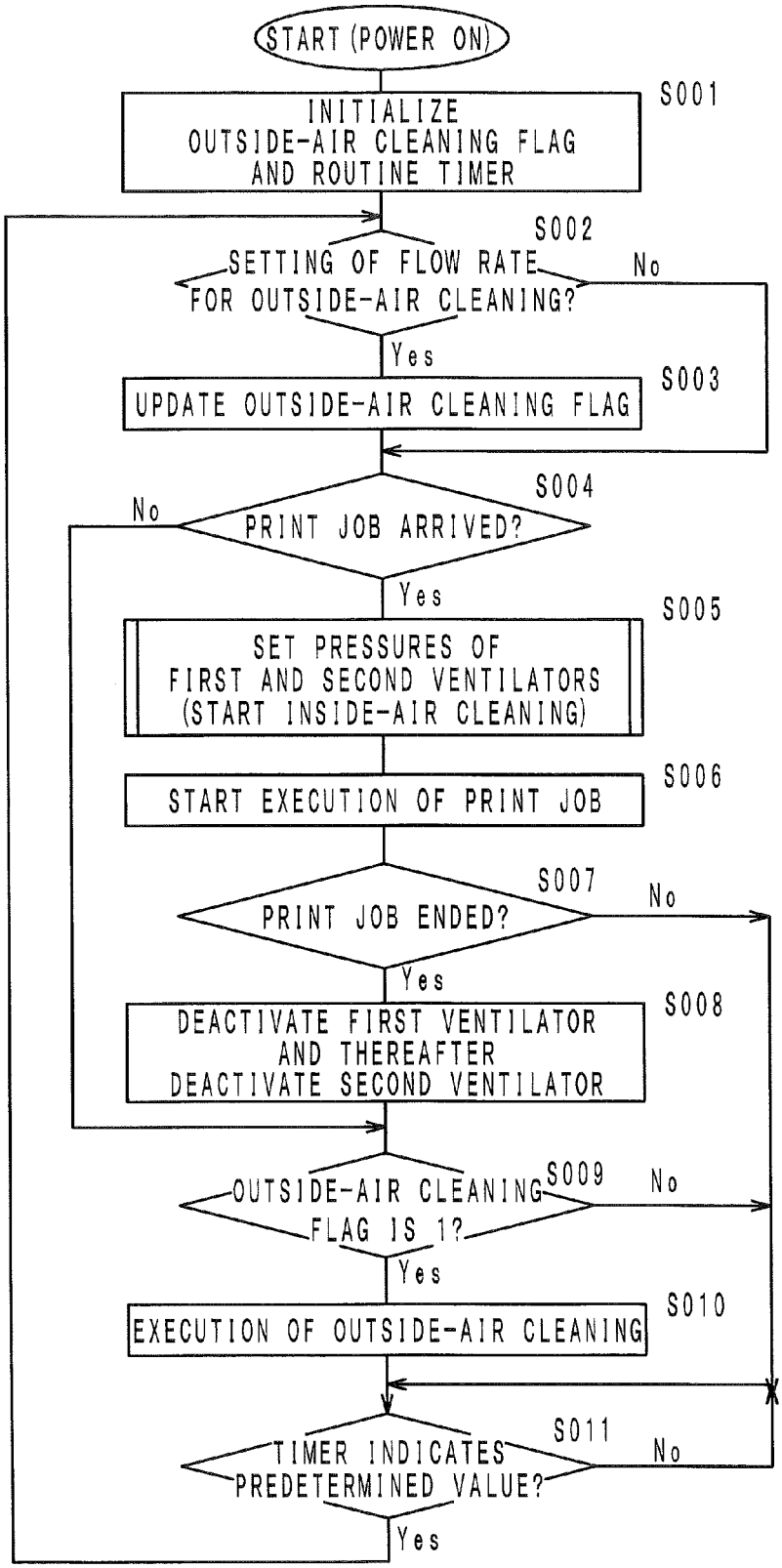
FIG. 6 is a control flowchart of the air cleaner of FIG. 1.

The routine timer is a timer for adjusting the end timing of the process of S011 of FIG. 6.

Next, the CPU 71 determines whether or not a window for setting the flow rate of the second ventilator 86 in the outside-air cleaning has been invoked (S002). If Yes, the CPU 71 displays GUI buttons, or the like, which represent whether or not to carry out the outside-air cleaning on the touch panel of the console panel 6, and invites a user for selection. As the user selects whether or not to carry out the outside-air cleaning in response, the CPU 71 updates the value of the outside-air cleaning flag F (S003). On the contrary, if No at S002, the CPU 71 skips S003 and carries out S004.

Then, the CPU 71 determines whether or not a print job has arrived from, for example, an image scanner (not shown) provided at the upper level of the image forming apparatus 1A (S004). If No, the CPU 71 skips S005 to S008 and carries out S009. On the contrary, if Yes at S004, the CPU 71 sets the pressures P1, P2 of the first ventilator 83 and the second ventilator 86 of the air cleaner 8A and starts the inside-air cleaning (S005).

Figure 7:
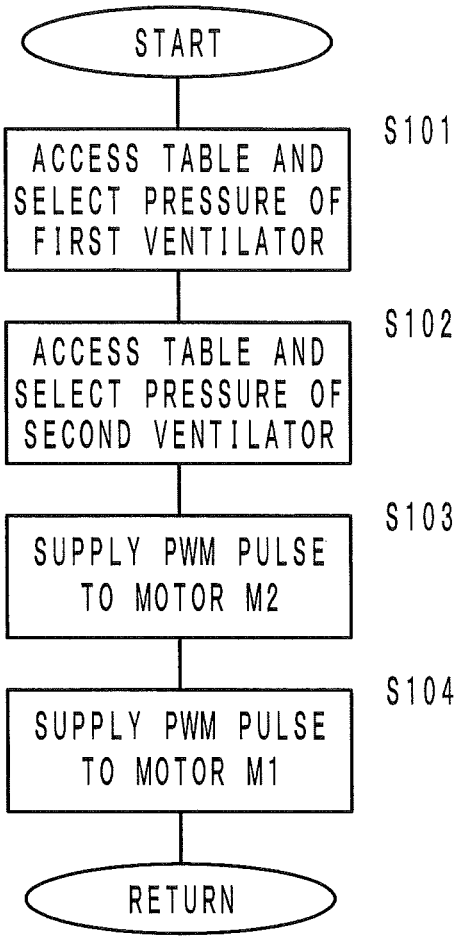
FIG. 7 is a detailed control flowchart of S005 of FIG. 6.

Specifically, as shown in FIG. 7, firstly, based on the contents of the print job, the CPU 71 accesses the table 74A (see TABLE 1) of the ROM 72 and selects a set of the flow rate Q1 and the pressure P1 (S101). The process of S101 is now described in more detail. In general, from the viewpoint of improving the collection efficiency of the inside-air filter 82, it is desired that the flow rate Q1 in the inside-air duct 81 is as small as possible. However, in some cases, the contents of the print job may direct not only to expel the air around the fixing unit 5 but also to cool surroundings of the developing unit of the image forming section 4 or cool the sheet Sh which has passed through the fixing unit 5. Since there is a probability that the air used for cooling contains toners or paper dust, this air is guided to the inside-air duct 81. Therefore, the portions to be cooled can vary according to the contents of the print job, and thus, the appropriate flow rate Q1 may vary in some cases. In view of such, the appropriate flow rate Q1 is determined beforehand for each of the contents of the print job by experiment in designing of the image forming apparatus 1A. At S101, the CPU 71 selects an appropriate flow rate Q1 and a corresponding pressure P1 from the table 74A based on the contents of the print job.

Then, the CPU 71 selects, from the table 74A, a set of the flow rate Q2 and the pressure P2 corresponding to the flow rate Q1 selected at S101 (S102).

Then, the CPU 71 generates a PWM pulse of a duty ratio represented by the pressure P2 selected at S102 and supplies the generated PWM pulse to the motor M2. Accordingly, the second ventilator 86 produces the pressure P2 selected at S102 toward the downstream side of the outside-air duct 84 (S103).

Then, the CPU 71 generates a PWM pulse of a duty ratio represented by the pressure P1 selected at S101 and supplies the generated PWM pulse to the motor M1. Accordingly, the first ventilator 83 produces the pressure P1 selected at S101 toward the downstream side of the inside-air duct 81 (S104). Accordingly, the air inside the image forming apparatus 1A is guided to the inside-air duct 81 and passed through the inside-air filter 82 at a predetermined flow rate and thereby cleaned. This air is further guided to the common filter 88 and cleaned by the common filter 88, and thereafter expelled from the outlet T3. Here, it is desired that the predetermined flow rate is small from the viewpoint of improving the collection efficiency of emissions that are microparticles. By setting of the pressure P1, the predetermined flow rate is adjusted to, for example, about 0.25 $m^3$/min.

After S104 that has been described above is completed, the CPU 71 withdraws from the flow of FIG. 7 and carries out S006 of FIG. 6. At S006, the CPU 71 starts execution of the print job (S006). Note that, as for execution of the print job, the CPU 71 follows a flow other than the flow of FIG. 6 and executes the print job concurrently with the flow of FIG. 6.

Then, the CPU 71 determines whether or not the print job has ended (S007). If Yes, the CPU 71 deactivates the first ventilator 83 and thereafter deactivates the second ventilator 86 (S008).

Then, the CPU 71 determines whether or not the outside-air cleaning flag F represents 1 (S009). If Yes at S009, the CPU 71 generates a PWM pulse having a duty ratio which represents a predetermined pressure for the outside-air cleaning and supplies the generated PWM pulse to the motor M2. Accordingly, the second ventilator 86 produces the predetermined pressure toward the downstream side of the outside-air duct 84 (S010). Accordingly, the air outside the image forming apparatus 1A is guided to the outside-air duct 84 and passed through the outside-air filter 85 at a predetermined flow rate and thereby cleaned. Thereafter, this air is guided to the common filter 88 and cleaned by the common filter 88, and thereafter expelled from the outlet T3. Here, in the case where the installation space is about 33 $m^2$, the predetermined flow rate needs to be about 3 $m^3$/min, which is largely different from that of the inside-air cleaning.

On the contrary, if No at either S007 or S009, the CPU 71 determines whether or not the routine timer has counted a predetermined value (S011). If No, the CPU 71 carries out S011 again. If Yes, the CPU 71 returns to S002.

Effects and Functions of Image Forming Apparatus

According to the present embodiment, the inside-air cleaning is carried out during execution of the print job. Before the inside-air cleaning, the pressure P1 is appropriately set for obtaining the flow rate Q1 in the inside-air duct 81. As a result, the flow rate Q1 varies in the inside-air duct 81. However, in the present embodiment, the pressure P2 is appropriately set such that the flow rate Q2 is generally constant irrespective of the variation of the flow rate Q1. As a result, the flow rate Q2 in the outside-air duct 74 can be maintained generally constant. This enables to prevent a backflow from the inside-air duct 81 to the outside-air duct 84.

More specifically, the flow rate Q2 achieved when the first ventilator 83 is not in operation (i.e., when P1=0) is Qa, and the flow rate Q2 achieved when the first ventilator 83 is in operation (i.e., when P1≠0) is Qb. In the above-described embodiment, the pressure P2 is set such that Qb=Qa=0 holds true. Thus, even when the inoperative first ventilator 83 is activated so that the flow rate Q1 varies, the flow rate Q2 is controlled so as to be constant at 0. This enables not only to prevent a backflow but also to prevent the air outside the image forming apparatus 1A from being guided to the common filter 88. As a result, the common filter 88 only needs to process the air inside the image forming apparatus 1A, and the collection efficiency during the inside-air cleaning can be improved.

Note that the pressure P2 is not limited to the above example, but may be set such that Qb>Qa holds true. For example, the pressure P2 may be set to a value which is higher by 10% than the value of the pressure P2 shown in TABLE 2. In this case, as compared with a case of Qb=Qa=0, the collection efficiency during the inside-air cleaning decreases slightly, but a backflow can be prevented more certainly. That is, in the case of Qb=Qa=0, there is a probability that a backflow occurs in some products due to, for example, variations in manufacture of the image forming apparatus 1A. However, in the case of Qb−Qa>0, the probability of occurrence of a backflow can be reduced irrespective of variations in manufacture of the image forming apparatus 1A.

Further, according to the present embodiment, S103 and S104 of FIG. 7 are carried out in this order. Specifically, the CPU 71 controls the ventilators such that the second ventilator 86 starts its operation earlier than the first ventilator 83 and enters the stable operation. As a result, a pressure is produced from the second ventilator 86 in the downstream direction earlier than the pressure from the first ventilator 83, so that a backflow can be prevented. Likewise, at S008 of FIG. 6, the first ventilator 83 is deactivated earlier, so that a backflow can be prevented.

According to the present embodiment, as shown in FIG. 5, the pressure P2 is generally proportional to the increase of the flow rate Q1. Thus, the flow rate Q2 in the outside-air duct 84 can be stabilized at 0.

Additional Remark 1

In the above-described embodiment, the CPU 71 sets the pressures P1, P2 according to the table 74A. However, the present invention is not limited to this example. The CPU 71 may store formulae (4) and (5) and derive the pressures P1, P2 by assigning the target values of the flow rates Q1, Q2 to formulae (4) and (5).

Additional Remark 2

In the above-described embodiment, as shown in FIG. 7, the second ventilator 86 is activated earlier while the first ventilator 83 is activated later. However, the present invention is not limited to this example. The first ventilator 83 and the second ventilator 86 may be activated at the same time.

First Modification

Next, an image forming apparatus 1B of the first modification is described. The image forming apparatus 1B has no difference in configuration from the above-described image forming apparatus 1A. Therefore, FIG. 1 to FIG. 5 are referred to for description of this modification. Components of the image forming apparatus 1B corresponding to those of the image forming apparatus 1A are designated by the same reference numerals, and the descriptions thereof are herein omitted.

Details of Control of Air Cleaner

Figure 8A:
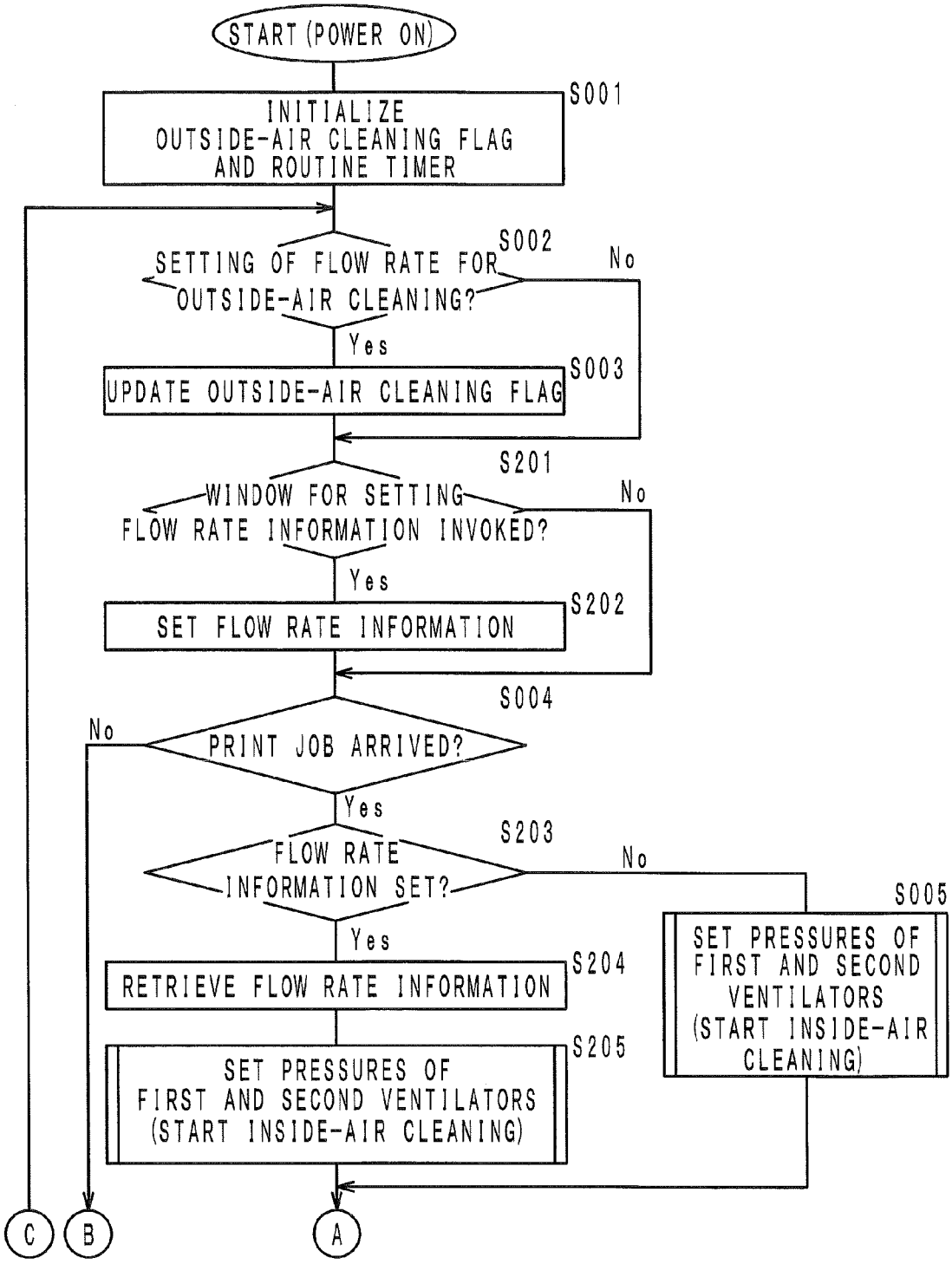
FIG. 8A is a diagram showing the first half of a control flow of an air cleaner of the first modification.
Figure 8B:
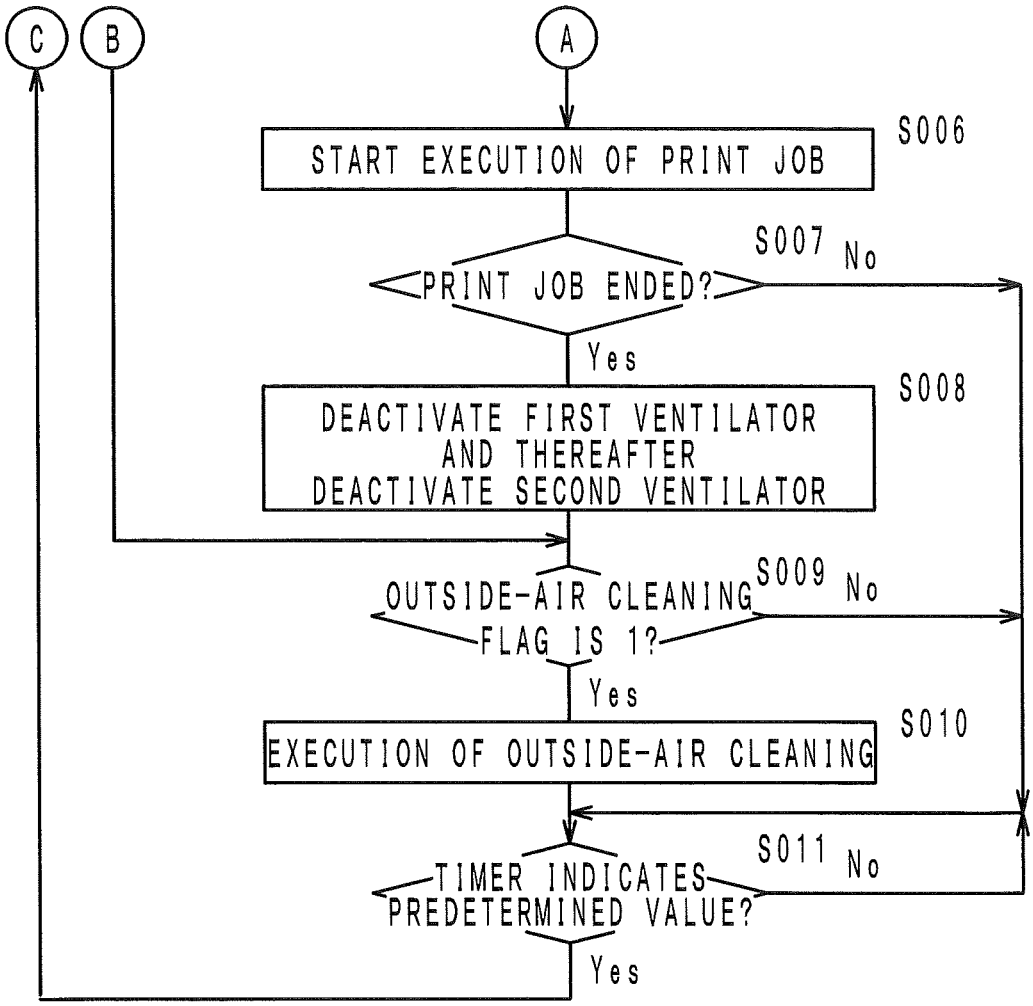
FIG. 8B is a diagram showing the second half of the control flow of FIG. 8A.

Next, the control of an air cleaner 8B of this modification is described in detail with reference to FIG. 8A, FIG. 8B, and FIG. 9. FIG. 8A and FIG. 8B are different from the flowchart of FIG. 6 in that S201 to S205 are further included. FIG. 8A and FIG. 8B have no other difference from FIG. 6. Thus, steps in FIG. 8A and FIG. 8B corresponding to those of FIG. 6 are designated by the same step numbers, and the descriptions thereof are herein omitted.

Immediately after the main power supply is turned on, the CPU 71 carries out S001 to S003 and thereafter determines whether or not a window for setting flow rate information G that is to be used in the inside-air cleaning has been invoked (FIG. 8A; S201).

The flow rate information G indicates the level of the flow rate Q2 which is to be set in the inside-air cleaning. In this modification, the flow rate information G represents any of five levels from L0 to L5. For the sake of convenience of description, levels L0 to L5 mean the flow rate Q1 shown in TABLE 2. More specifically, as for the flow rate Q1, level L0 is 0, level L1 is 0.1, level L2 is 0.2, level L3 is 0.3, and level L4 is 0.4.

If Yes at S201, the CPU 71 displays GUI buttons, or the like, which represent levels L1 to L5 on the touch panel of the console panel 6, and invites a user for selection. As the user selects any level L in response, the CPU 71 sets the flow rate information G (S202).

If No at S201, or after S202 is carried out, the CPU 71 carries out S004.

Then, the CPU 71 determines whether or not the flow rate information G has been set (S203). If Yes, the CPU 71 retrieves the set level L of the flow rate information G (S204) and sets the pressures P1, P2 of the first ventilator 83 and the second ventilator 86 of the air cleaner 8B based on the retrieved flow rate information G, and starts the inside-air cleaning (S205).

Figure 9:
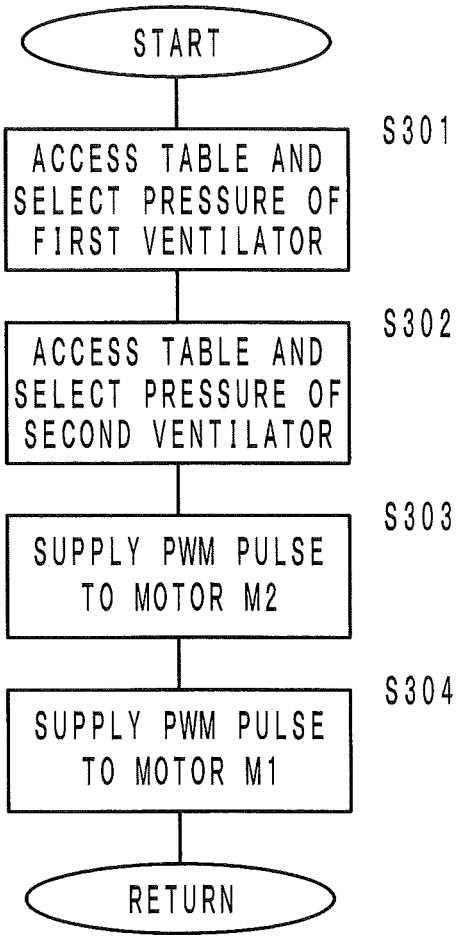
FIG. 9 is a detailed control flowchart of S205 of FIG. 8A.

Specifically, as shown in FIG. 9, the CPU 71 first accesses the table 74A (see TABLE 1) of the ROM 72 and selects a set of the flow rate Q1 and the pressure P1 corresponding to the level L of the flow rate information G (S301).

Then, the CPU 71 selects, from the table 74A, a set of the flow rate Q2 and the pressure P2 corresponding to the flow rate Q1 selected at S301 (S302).

Then, the CPU 71 instructs the second ventilator 86 to produce the pressure P2 selected at S302 in the same way as S103 that has been previously described (S303).

Then, the CPU 71 instructs the first ventilator 83 to produce the pressure P1 selected at S301 in the same way as S104 that has been previously described (S304).

After S304 that has been described above is completed, the CPU 71 withdraws from the flow of FIG. 9 and carries out S006 and subsequent steps of FIG. 8B.

If No at S203, the CPU 71 carries out S005 and thereafter carries out S006 and subsequent steps of FIG. 8B.

The control realized by the first modification that has been described hereinabove also enables to achieve the same functions and effects as those of the previously-described embodiment.

Additional Remark 1

In the above description of the modification, setting of the pressures P1, P2 based on the flow rate information G set by a user (S205) and setting of the pressures P1, P2 based on the contents of the print job (S005) are selectively carried out. However, the present invention is not limited to this example. S005 may be omitted while only S205 is carried out.

Second Modification

Figure 10:
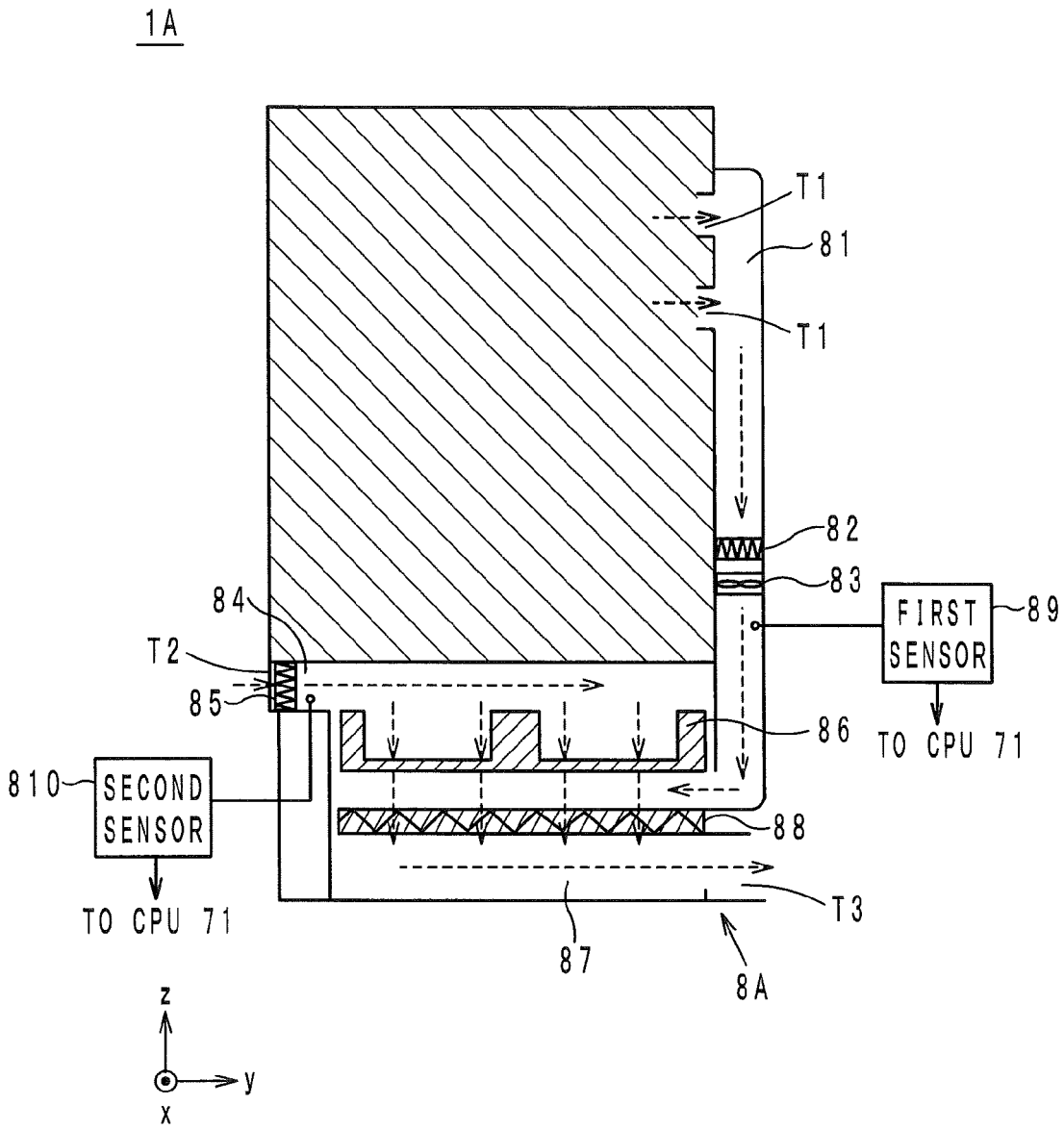
FIG. 10 is a vertical cross-sectional view parallel to the yz plane of an air cleaner of the second modification.

In the above-described embodiment, at S005 of FIG. 6, the CPU 71 sets the pressures P1, P2 based on the table 74A such that the target values of the flow rates Q1, Q2 are achieved. However, the present invention is not limited to this example. As shown in FIG. 10, for example, a first sensor 89 which is capable of outputting a signal indicative of the flow rate itself (or the variation of the flow rate), such as an air flow meter, barometer, or anemometer, may be provided immediately downstream of the first ventilator 83 in the inside-air duct 81, and a second sensor 810 which is the same type as the first sensor 89 may be provided immediately downstream of the outside-air filter 85 in the outside-air duct 84. In this case, the CPU 71 may exercise feedback control of the pressures P1, P2 of the ventilators 83, 86 based on the detection results of the sensors 89, 810 such that the target values of the flow rates Q1, Q2 are achieved.

Third Modification

Figure 11:
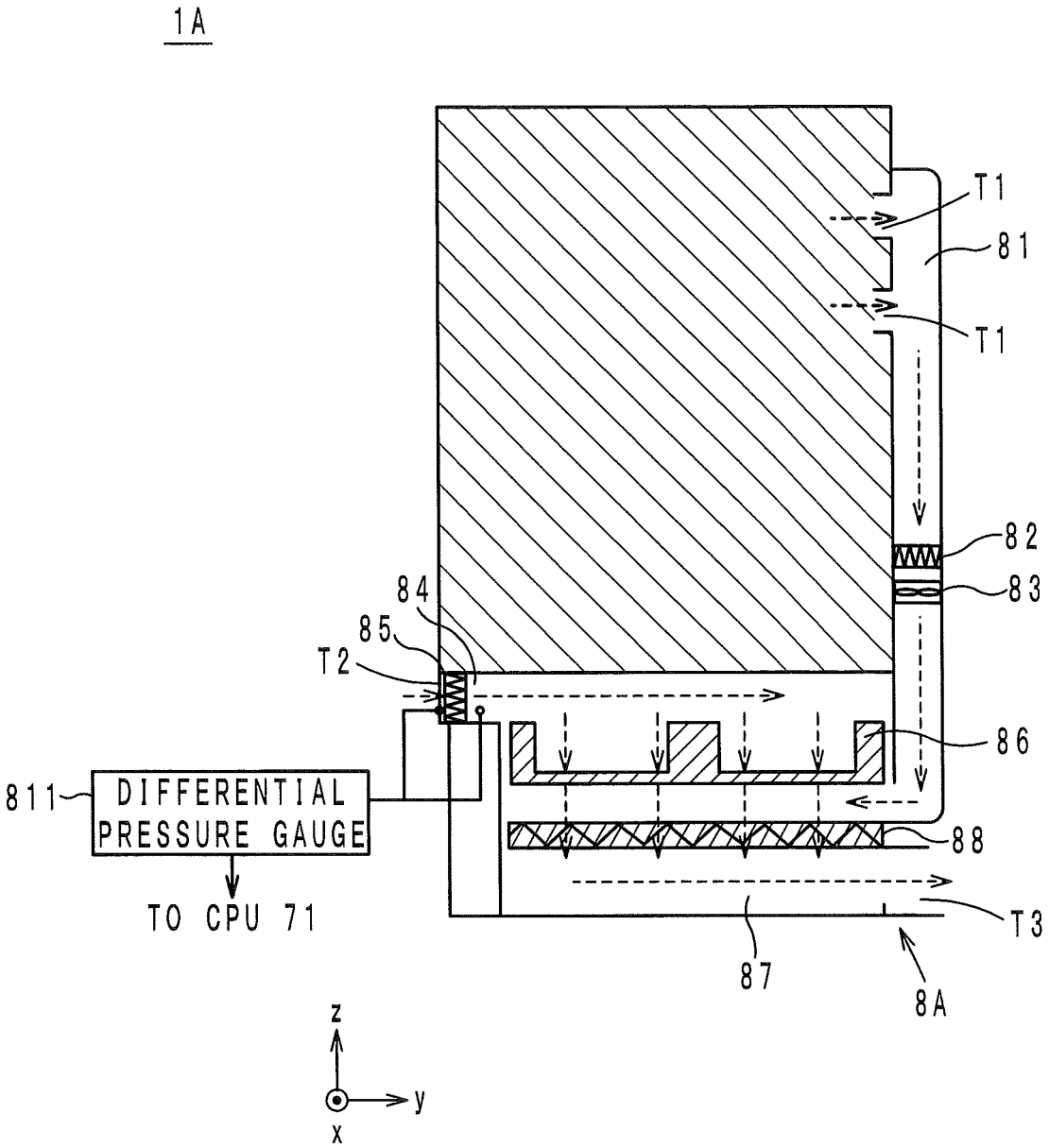
FIG. 11 is a vertical cross-sectional view parallel to the yz plane of an air cleaner of the third modification.

In the above-described embodiment, the CPU 71 controls the pressure P2 based on the table 74A such that the variation of the flow rate Q2 is generally constant. However, the present invention is not limited to this example. As shown in FIG. 11, for example, a differential pressure gauge 811 may be provided immediately upstream and downstream of the outside-air filter 85 in the outside-air duct 84. In this case, the CPU 71 controls the pressure P2 such that the detection result of the differential pressure gauge 811 (i.e., the pressure difference between the upstream side and the downstream side) becomes generally 0.

Fourth Modification

Figure 12:
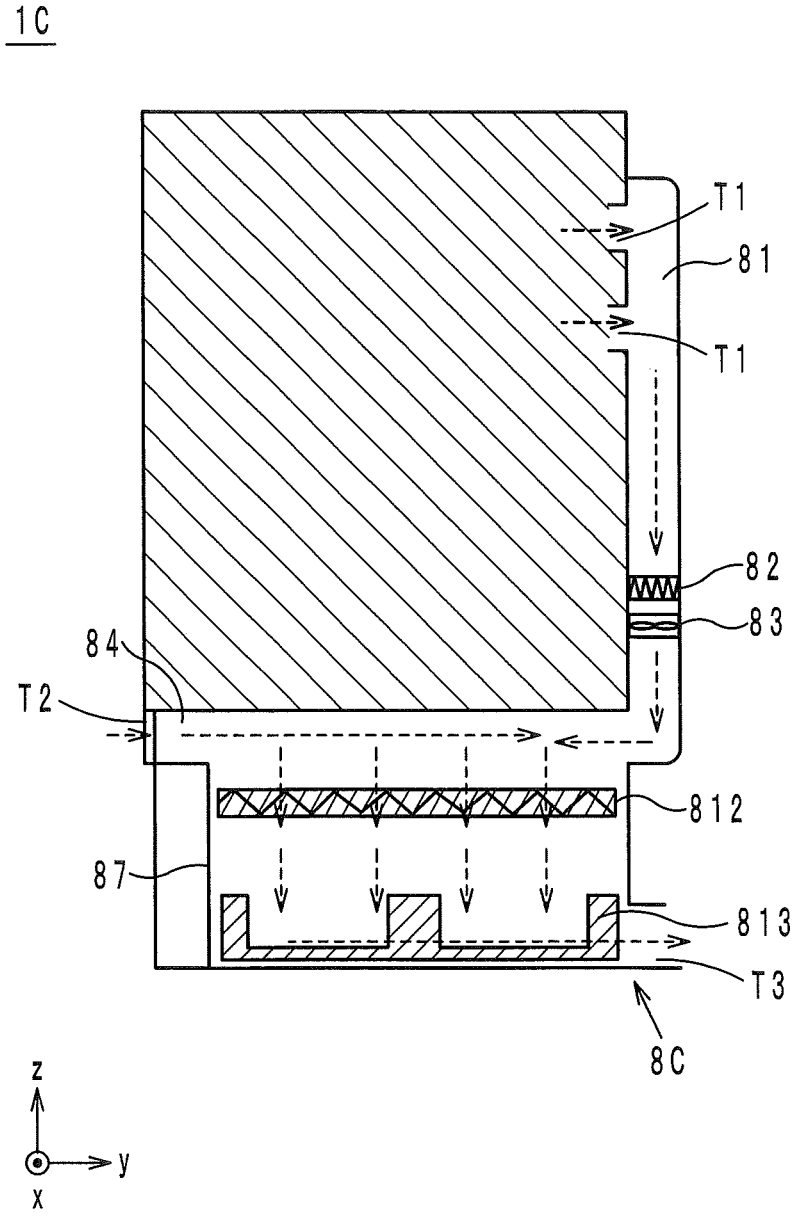
FIG. 12 is a vertical cross-sectional view parallel to the yz plane of an air cleaner of the fourth modification.
Figure 13:
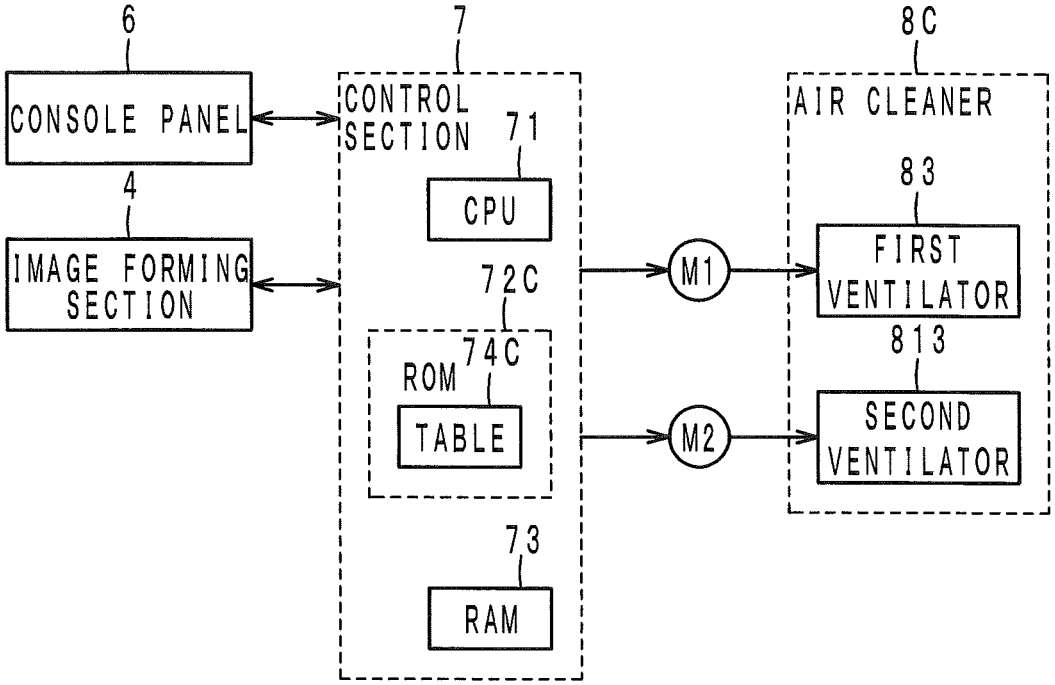
FIG. 13 is a control block diagram of the air cleaner of FIG. 12.

Next, an image forming apparatus 1C of the fourth modification is described. The image forming apparatus 1C is different from the image forming apparatus 1A in that an air cleaner 8C is included in place of the air cleaner 8A as shown in FIG. 1. The air cleaner 8C is different from the air cleaner 8A in that a common filter 812 and a second ventilator 813 are included in place of the outside-air filter 85 and the second ventilator 86 as shown in FIG. 12 and FIG. 13.

The common filter 812 and the second ventilator 813 are both provided in the air passage of the common duct 87. More specifically, the common filter 812 is provided upstream of the second ventilator 813.

The area of the common filter 812 is generally equal to the cross-sectional area of the common duct 87. The common filter 812 removes emissions, dust, etc., from the air guided through the air passage of the common duct 87.

The second ventilator 813 is a blast fan, for example. The motor M2 is coupled with the second ventilator 813. The control section 7 controls the number of revolutions of the motor M2 by PWM control, and the second ventilator 813 is rotated by a driving force from the motor M2, whereby a pressure is produced at the downstream side in the air passage. Accordingly, the air passed through the common filter 812 is guided toward the outlet T3.

Figure 14:
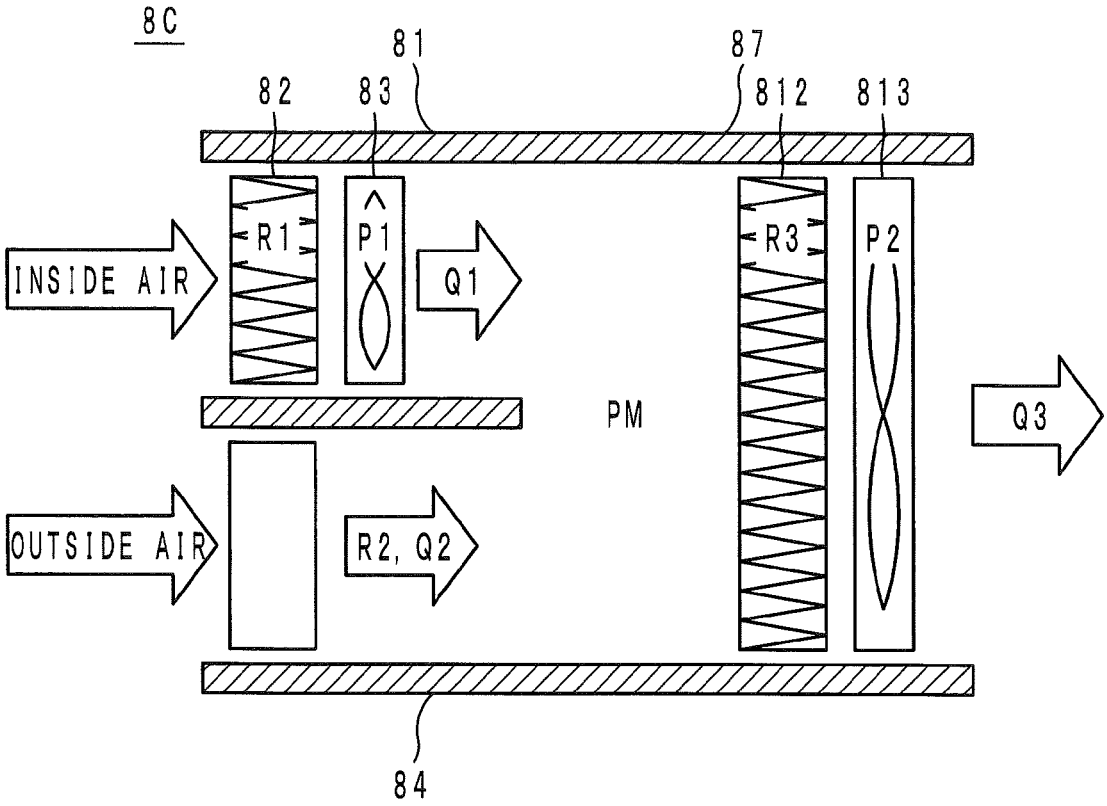
FIG. 14 is a schematic diagram showing the pressure, flow rate and ventilation resistance in a major part of FIG. 12.

Variables and constants (known values) of the major part of the air cleaner 8C that has the above-described configuration are defined as shown in FIG. 14 and TABLE 3.

TABLE 3

Definition of Variables/Constants

| Symbol | Variable/ Constant | Definition |
|---|---|---|
| P1 | Variable | Pressure of First Ventilator 83 |
| R1 | Constant | Ventilation resistance of Inside-Air Duct 81 |
| Q1 | Variable | Flow rate in Inside-Air Duct 81 |
| R2 | Constant | Ventilation resistance of Outside-Air Duct 84 |
| Q2 | Variable | Flow rate in Outside-Air Duct 84 |
| P2 | Variable | Pressure of Second Ventilator 813 |
| R3 | Constant | Ventilation resistance of Common Duct 87 |
| Q3(=Q1 + Q2) | Variable | Flow rate in Common Duct 87 |
| PM | Variable | Internal Pressure Between Ventilator 83 and Filter 812 |

In this modification also, the pressure loss which is attributed to the ventilation resistance in the duct including the filter is the product of the ventilation resistance of the filter and the flow rate, as in the above-described embodiment. Thus, formulae (6) to (8) shown below hold true. Note that, in FIG. 14, the air is assumed to flow in a rightward direction.

$$P1-PM=R1Q1 \tag{6}$$

$$-PM=R2Q2 \tag{7}$$

$$P3+PM=R3(Q1+Q2) \tag{8}$$

From formulae (6) to (8), formula (9) which represents the relationship between P1 and Q1, Q2 and formula (10) which represents the relationship between P3 and Q1, Q2 are obtained as follows.

$$P1=(R1+R3)Q1+-P3+R3Q2 \tag{9}$$

$$P3=(R2+R3)Q2+R3Q1 \tag{10}$$

Formulae (9) and (10) are for determining the set values of the pressures P1, P2 for the purpose of achieving the target value of the flow rate Q1 and the target value of the flow rate Q2. Here, to prevent the air from the inside-air duct 81 from forming a backflow to the outside-air duct 84 even though Q1 varies, it is required that Q2 is constant and would not vary irrespective of Q1. A table 74C is created for controlling the first ventilator 83 and the second ventilator 813 so as to satisfy formulae (4) and (5) such that Q2 is constant and would not vary irrespective of Q1. The table 74C is stored in a ROM 72C shown in FIG. 13 in manufacture of the image forming apparatus 1C.

TABLE 4 shows an example of the contents of the table 74C.

TABLE 4

Contents of Table 74C

| | | | | | |
|---|---|---|---|---|---|
| Q1 [$m^3$/min] | 0 | 0.1 | 0.2 | 0.3 | 0.4 |
| Q2 [$m^3$/min] | 0 | 0 | 0 | 0 | 0 |
| P1 Set Value [%] | 0 | 1.4 | 2.9 | 4.3 | 5.7 |
| P2 Set Value [%] | 0 | 2.9 | 5.7 | 8.6 | 11.4 |

Figure 15:
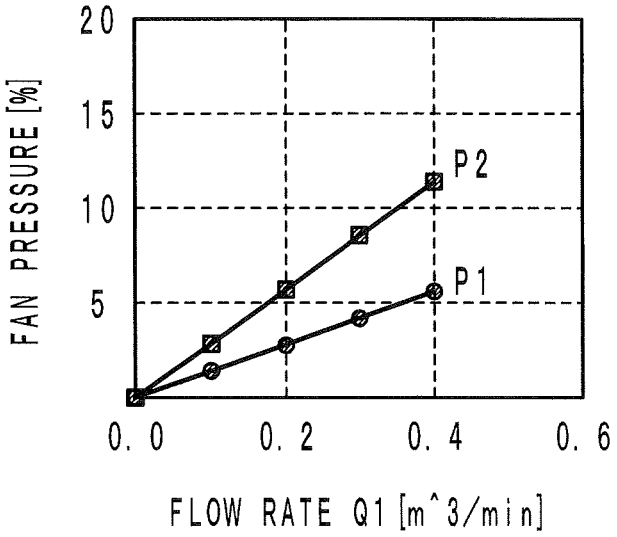
FIG. 15 is a graph of the pressures P1, P2 with respect to the flow rate Q1.

TABLE 4 shows the relationship of P1 to Q1 and the relationship of P2 to Q1, Q2. Note that the unit of P1, P2 is %. This represents the duty ratio in the PWM control of the motors M1, M2. According to TABLE 4, when the first ventilator 83 is off, the pressure P2 of the second ventilator 813 is set to 0. Relative to this value, the pressure P2 is set generally proportional along with the increase of the pressure P1 as shown in FIG. 15. Also, as previously described, the flow rate Q2 has a generally constant value irrespective of the flow rate Q1. In the example of TABLE 4, the flow rate Q2 is constant at 0, although the present invention is not limited to this example. The flow rate Q2 may be constant at any other value.

Hereinabove, the differences in configuration of this modification from the above-described embodiment have been described. Note that details of the control of the air cleaner 8C can be obtained by replacing the air cleaner 8A, the second ventilator 86 and the table 74A in the section of "Details of Control of Air Cleaner" of the above-described embodiment with the air cleaner 8C, the second ventilator 813 and the table 74C. Hence, description of the details of the control of the air cleaner 8C is herein omitted.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

an inside-air duct having a first inlet to an inside of the image forming apparatus;

a first ventilator provided in the inside-air duct;

an outside-air duct having a second inlet to an outside of the image forming apparatus;

a common duct into which the inside air duct and the outside-air duct are merged;

a second ventilator provided in at least one of the outside-air duct and the common duct;

a filter provided in the common duct; and a control section configured to retrieve information indicative of a flow rate in the inside-air duct and to increase a pressure produced by the second ventilator based on the retrieved information such that a flow rate in the outside-air duct is substantially constant with respect to an increase of the flow rate in the inside-air duct.

2. The image forming apparatus according to claim 1 wherein, in transition from a state where the first ventilator and the second ventilator are not in operation to a mode where air inside the image forming apparatus is expelled to the outside, the control section is configured to increase the pressure produced by the second ventilator along with the increase of the flow rate in the inside-air duct.

3. The image forming apparatus according to claim 1, wherein the control section configured to control the pressure produced by the second ventilator such that $Qb \geq Qa$ holds true where Qa is a flow rate in the outside-air duct which is achieved when the first ventilator is not in operation and Qb is a flow rate in the outside-air duct which is achieved when the first ventilator is in operation.

4. The image forming apparatus according to claim 1, wherein the control section configured to activate the second ventilator earlier than the first ventilator.

5. The image forming apparatus according to claim 1, wherein the control section configured to increase the pressure produced by the second ventilator generally proportionally to the increase of the flow rate in the inside-air duct.

6. The image forming apparatus according to claim 1, wherein the control section configured to deactivate the first ventilator earlier than the second ventilator after completion of a print job.

* * * * *